United States Patent [19]

Colonna

[11] Patent Number: 5,072,683

[45] Date of Patent: Dec. 17, 1991

[54] DRAINABLE PROTECTIVE BOAT MOTOR BAG APPARATUS

[76] Inventor: Frank Colonna, 203 Glendora Ave., Long Beach, Calif. 90803

[21] Appl. No.: 620,629

[22] Filed: Dec. 3, 1990

[51] Int. Cl.[5] ..... B63B 59/00

[52] U.S. Cl. ..... 114/222; 440/113; 440/900

[58] Field of Search ..... 114/343, 361, 365, 219, 114/221 R; 150/154, 157, 158, 160, 161, 166, 901; 440/71, 113, 900

[56] References Cited

U.S. PATENT DOCUMENTS

| | | |
|---|---|---|
| 1,489,704 | 4/1924 | Kleshick . |
| 2,434,784 | 1/1948 | Bardin . |
| 2,475,135 | 7/1949 | Hanes . |
| 2,498,113 | 2/1950 | Milner . |
| 2,609,164 | 9/1952 | Dillon . |
| 3,101,109 | 8/1963 | Hawley . |
| 3,587,508 | 6/1971 | Pearce . |
| 3,870,875 | 3/1975 | Altimus . |
| 3,886,889 | 6/1975 | Burger ..... 440/113 |
| 4,869,695 | 9/1989 | Satdak ..... 440/88 |

*Primary Examiner*—Jesus D. Sotelo
*Assistant Examiner*—Stephen P. Avila
*Attorney, Agent, or Firm*—Fulwider, Patton, Lee & Utecht

[57] ABSTRACT

A drainable protective boat motor bag apparatus including a boot defining a bag for fitting over the propeller and stem of an outdrive of a motor mounted on the stern of a boat. The bag includes a channel extending from the mouth thereof to the closed end of the bag for receipt of an open ended hose such that, once the bag has been positioned over the stem, a hose may be inserted for pumping of residual from such bag. A tie string may be incorporated around the mouth of the bag for tying it to the stem and, if desirable, a separate protective sack may be included for covering the propeller blades to protect them from direct exposure to the bag itself.

6 Claims, 1 Drawing Sheet

FIG. 1
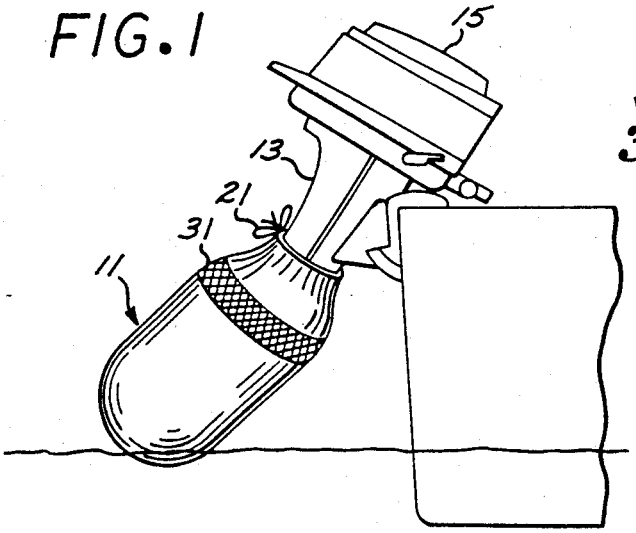
FIG. 2
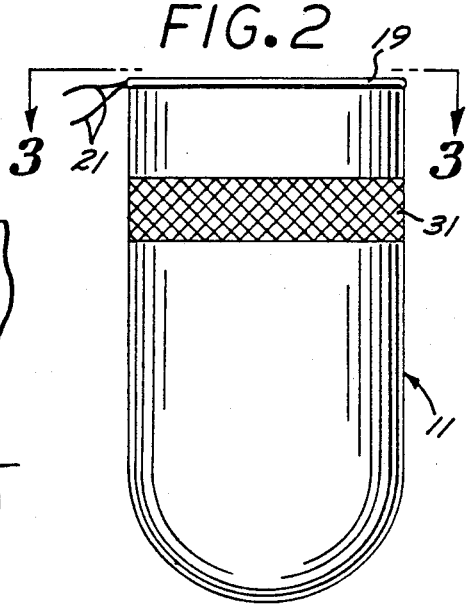
FIG. 3
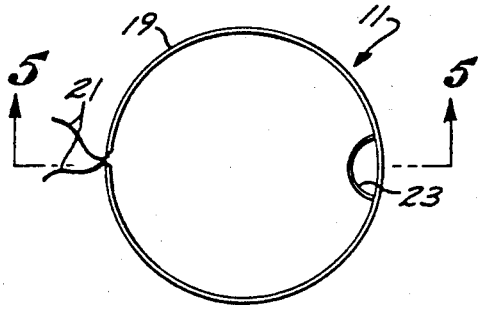
FIG. 4
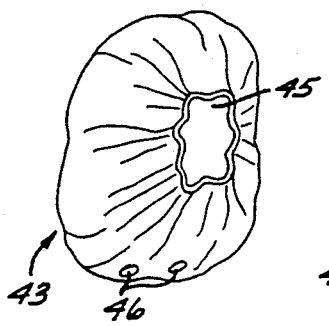
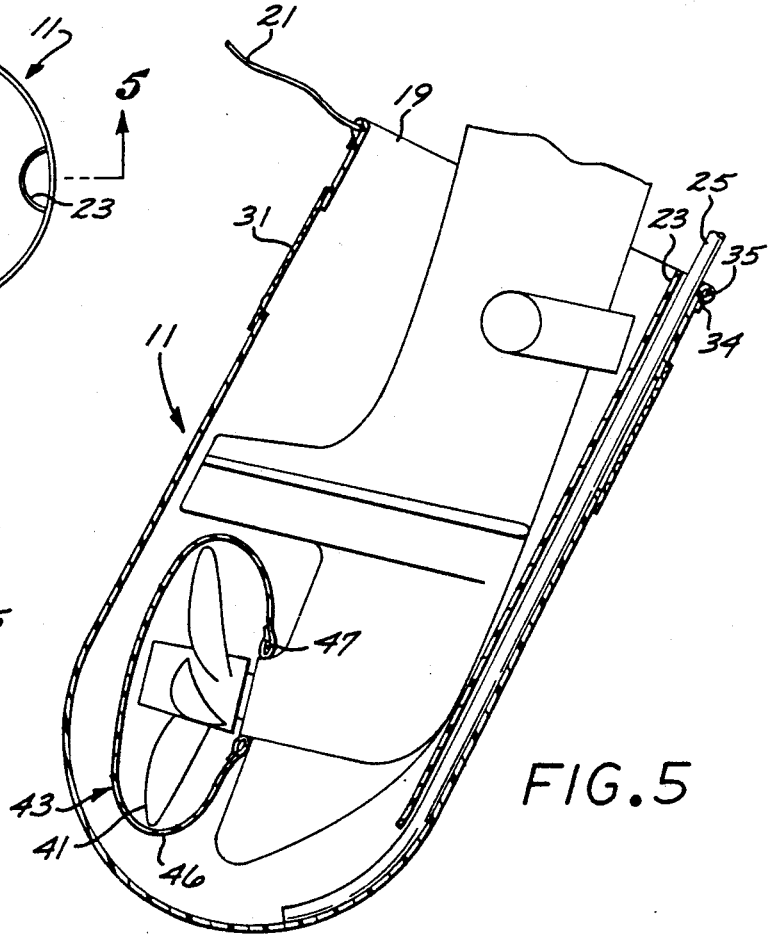
FIG. 5

DRAINABLE PROTECTIVE BOAT MOTOR BAG APPARATUS

BACKGROUND OF THE INVENTION

1. Field of the Invention

The present invention relates to a covering bag for covering a boat motor outdrive to isolate it from the surrounding environment and protect it from corrosion.

2. Description of the Prior Art

With the popularity of water sports and recreation, the use of boats incorporating outdrives have gained in popularity. It is recognized that outdrives enjoy certain advantages in maneuverability of the powered vessel in negotiating turns and maneuvering in close quarters to dock side moorings. Many owners prefer, during the recreational season, to avoid the inconvenience and time consuming effort required to haul the powered vessel for storage at the end of each period of use.

Mooring of a boat in sea water, while adding to the convenience and enjoyment of the boat, possesses certain well known drawbacks. For instance, even for outdrives incorporating hydraulic or electrical motors enabling the stems thereof to be tilted up to raise the lower end relative to the water line, it is well known that because of design considerations and variations in motor mounts, the outdrive typically cannot be sufficiently elevated to fully clear the water line. This then frequently leaves the lower end of the stem and sometimes a portion of the propeller partially submerged in seawater leading to corrosion and rapid growth of sea life on the lower portion of the outdrive during extended periods of non-use.

Past efforts have led to the development of what is typically referred to as boat baths wherein a hammock-like water proof plastic sheet or the like is suspended beneath the hull of a moored boat with the peripheral edges thereof elevated above the water line by either flotation means or by securing to the dock itself. A flap is typically provided at the stern of the mooring which may be lowered for accommodating ingress and egress of the boat itself. When the boat is moored, the flap may be raised and water in the bath treated to retard sea growth or the like. Such baths, while retarding sea growth, suffer the shortcoming that they are relatively large, expensive to manufacture, somewhat unwieldy to install and use, and typically fail to insulate outdrives from any retained sea water.

Efforts to afford protection for outdrives themselves have led to the proposal of framework for fitting over an outdrive such that a protective canvas bag may be fitted thereover and tethered in position in effort to isolate and maintain water within the cover insulated from the ambient sea water. A device of this type is shown in U.S. Pat. No. 3,587,508 to Pearce. Protective covers of this type, while satisfactory for their intended use, suffer the shortcoming that the top of the cover is maintained open by the framework such that ambient sea water may be splashed thereinto and the cover itself is designed to retain residual sea water. While, to the extent residual sea water is effectively segregated from the ambient water, it may be treated to retard sea growth, it typically retains its corrosive effect.

It has also been proposed to cover an outdrive with a bag-shaped device during trailering of the boat. Such a device is shown in U.S. Pat. No. 3,870,875 to Altimus. Such covers, while satisfactory for trailering of the boat, fail to afford protection from the corrosive and detrimental effects of surrounding sea water while the boat is moored.

Thus, there exists a need for an outdrive cover which will protect the outdrive from the corrosive effects while the boat is moored for extended periods of time.

SUMMARY OF THE INVENTION

The drainable protective motor boat bag apparatus of the present invention is characterized by an envelope which is formed with an open mouth for receipt over the stem of an outdrive to be fitted upwardly thereover and secured in position to isolate the stem from the surrounding sea water. Preferably a sleeve or channel is incorporated on the interior of the bag for receipt of a hose to lead such hose downwardly to the bottom of the bag so that residual water therein can be withdrawn through the hose.

Other objects and features of the invention will become apparent from consideration of the following description taken in connection with the accompany drawings.

BRIEF DESCRIPTION OF THE DRAWINGS

FIG. 1 is a side view of a drainable protective motor boat bag apparatus of the present invention;

FIG. 2 is a front view, in enlarged scale, of the bag apparatus shown in FIG. 1;

FIG. 3 is a top plan view, taken the line 3—3 of FIG. 2;

FIG. 4 is a perspective view of a protective sack incorporated in the apparatus of FIG. 1; and FIG. 5 is a vertical sectional view, in enlarged scale, taken along the line 5—5 of FIG. 3.

DESCRIPTION OF THE PREFERRED EMBODIMENT

Referring to FIGS. 1 and 5, the protective boat motor bag apparatus of the present invention includes, generally, a water resistant boot 11 configured to be fitted over the stem 13 of the outdrive of an outboard motor 15. The boot 11 is formed at its top end with an open mouth 19 incorporating a peripheral passage which receives a drawstring 21 for fastening the bag in position. An interior sleeve extends from the mouth 19 to the bottom end of the bag to define a channel 23 which receives an open ended tube 25. Thus, the bag may be fitted about the outdrive stem 13 as shown in FIG. 1 and the tube 25 inserted thereinto and connected with a pump to evacuate the water from the interior of the bag thus isolating the outdrive from the surrounding sea water to thus retard the corrosive effects thereof.

It is well known that the corrosive effects of marine air is highly detrimental to the life of outboard engines. It is appreciated that covering of the outdrive to minimize contact with the sea water and sea water atmosphere will serve to reduce the rate of corrosion thereby prolonging the life of the outdrive itself. It is desirable to provide a cover which will minimize these corrosive effects but yet is rather compact and convenient to install on the outdrive while surmounted from the transom of a boat. It is recognized that any inconvenience of installing such protective devices may well detract from the convenience of use frequently leading to total disuse and consequent deterioration of the outdrive.

The protective bag of the present invention is preferably constructed of dacron or other tough water resistant material and is in the form of a closed ended boot which fits conveniently over the stem of the outdrive and extends upwardly along the stem to a location spaced above the water surface to thus minimize the deleterious effect of water splashing up onto the stem above the mouth and draining back downwardly into the interior of the boot itself.

Incorporated within the wall of the boot 11 at a location proximate the mouth 19 is a parametrical mesh belt 31 which provides for circulation of air into the boot to thus reduce and minimize condensation within such boot as a result of changing atmospheric conditions.

Referring to FIG. 5, the boot is turned outwardly and rolled back at about the mouth 19 to form a passage 35 for receipt of the drawstring 21 which may be utilized to tie the boot in position as shown in FIG. 1. In the preferred embodiment, a distendable rib 34 is incorporated in the seam of the turn back for the passage 25 to provide for the mouth of the boot being normally distended to its open position to thereby facilitate installation thereof on the outdrive. However, it will be appreciated by those skilled in the art that this feature is optional and that, on the other hand, the fastening of the boot could be achieved by merely providing a resilient bungy cord in the seam without any necessity of the distending rib.

The channel 23 is preferably also constructed of dacron and may be stitched or bonded to the interior surface of the boot 11 to thereby define the passage for receipt of the hose or tube 25 to lead it downwardly into the bottom of the boot as shown in FIG. 5.

It will be appreciated that for outdrives incorporating propellers 41, the edges of the propeller blades are typically relatively sharp thus providing a hazard of cutting or scarring dacron material drawn thereover. To minimize this effect, I have provided a protective propeller sack, generally designated 43, which is formed with an opening 45 having an elastic bungy cord type strip 47 surrounding such opening to normally draw it to the closed position shown in FIGS. 4 and 5. In the preferred embodiment, drain holes 46 are provided at spaced locations about the sack 43 to thus provide for water drainage therefrom and into the boot 11. Thus, the sack 43 may be fitted over the propeller in advance of the boot 11 and will be retained in position to cover the sharp edges of such propeller while the boot 11 is drawn into position.

In operation, it will be appreciated that when the boat mounting the outboard engine 15 is returned to its slip, the skipper may raise the outdrive to its elevated incline position shown in FIG. 1. The propeller 41 is then typically accessible by the operator then merely leaning rearwardly over the engine cowling or by reaching out from the dock to thus place the protective propeller sack 43 over the propeller as shown in FIG. 5.

The drawstring 21 is then left loose while the boot 11 is drawn upwardly over the bottom of the stem of the outdrive to the position shown in FIG. 5. The hose 25 may then be inserted in the channel 23 and extended down to the position shown in FIG. 5. The hose may then be connected with a jack rabbit pump or the bilge pump to thus draw the residual water from the bottom of the boot 11. The hose 25 may then be withdrawn from the channel 23 and, if desirable, the drawstring 21 tightened downwardly over the stem to firmly hold the boot in position. It will then be appreciated that the bottom of the outdrive is protected from direct contact with the seawater and the stem itself is protected from direct contact with marine air moving therepast. However, in the event of changing climatic conditions, ventilation will be afforded through the mesh belt 3 to thus minimize the tendency of condensation to collect within the boot 11.

From the foregoing it will be appreciated that the drainable protective boat motor bag apparatus of the present invention provides a convenient and effective means to afford protection to an outdrive against the detrimental effects of marine air during long periods of non-usage of the boat powered by such outdrive.

Various modifications and changes may be made with regard to the foregoing detailed description without departing from the spirit of the invention.

I claim:

1. Drainable protective boat motor bag apparatus for fitting over a stem of an outdrive of a motor mounted on a transom of a boat and adapted for connection to a water pump and comprising:

a water resistant boot to fit over such propeller and stem, formed with a closed bottom wall, and terminating at its top end in an open mouth adapted to collapse and close on said stem;

fastening means for fastening said mouth onto said stem; and an open ended channel in said boot extending from said mouth to terminate proximate said bottom wall for receiving an open ended hose to be passed telescopically therethrough whereby said boot may be fitted over stem, said hose inserted in said channel to project from said outlet so that such pump may be connected to said hose to draw any residual water from said boot.

2. Drainable protective boat motor bag apparatus according to claim 1 wherein:

said boot includes air pervious ventilation means in a side wall thereof for ventilation of air from the interior thereof.

3. Drainable protective boat motor bag apparatus according to claim 1 wherein:

said boot includes a stiffener rib for normally retaining said mouth in a distended open position.

4. Drainable protective boat motor bag apparatus according to claim 1 wherein:

said fastening means includes a tie string.

5. Drainable protective boat motor bag apparatus according to claim 1 for fitting over an outdrive mounting an exposed propeller and further including:

a sack for closely fitting over such propeller and including an opening for receipt of such propeller and closure means for retaining such sack on such propeller.

6. Drainable protective boat motor bag apparatus according to claim 5 wherein:

said sack is formed with drain holes for draining of water therefrom.

* * * * *